US007054815B2

(12) United States Patent
Yamada et al.

(10) Patent No.: US 7,054,815 B2
(45) Date of Patent: May 30, 2006

(54) SPEECH SYNTHESIZING METHOD AND APPARATUS USING PROSODY CONTROL

(75) Inventors: Masayuki Yamada, Kanagawa (JP); Yasuhiro Komori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 476 days.

(21) Appl. No.: 09/818,886

(22) Filed: Mar. 27, 2001

(65) Prior Publication Data

US 2001/0037202 A1 Nov. 1, 2001

(30) Foreign Application Priority Data

Mar. 31, 2000 (JP) ..... 2000-099422

(51) Int. Cl.
*G10L 13/00* (2006.01)

(52) U.S. Cl. ..... 704/267; 704/258

(58) Field of Classification Search ..... 704/258, 704/267

See application file for complete search history.

(56) References Cited

U.S. PATENT DOCUMENTS 5,479,564 A * 12/1995 Vogten et al. ..... 704/267
5,633,984 A 5/1997 Aso et al.
5,845,047 A 12/1998 Fukada et al.
5,864,812 A * 1/1999 Kamai et al. ..... 704/268
5,987,413 A * 11/1999 Dutoit et al. ..... 704/267
6,144,939 A * 11/2000 Pearson et al. ..... 704/258
6,377,917 B1 * 4/2002 Gimenez De Los Galanes et al. ..... 704/220
6,438,522 B1 * 8/2002 Minowa et al. ..... 704/258
6,470,316 B1 * 10/2002 Chihara ..... 704/267
6,591,240 B1 7/2003 Abe

FOREIGN PATENT DOCUMENTS

| | | |
|---|---|---|
| EP | 0 942 408 | 3/1999 |
| EP | 0 942 409 | 3/1999 |
| EP | 0 942 410 | 3/1999 |
| JP | 09-152892 A | 6/1997 |

OTHER PUBLICATIONS

Laroche, J, "Time and pitch scale modification of audio signals," in Applications of Digital Signal Processing to Audio and Acoustics, Kahrs et al. Eds. Kluwer, 1998, pp. 279–309.*

Moulines et al. "Pitch–synchronous waveform processing techniques for text–to–speech synthesis using diphone," Speech Communications 9 (1990), pp. 453–467.*

Office Action dated Mar. 4, 2005 of Japanese Patent Application No. 2000–099422.

* cited by examiner

*Primary Examiner*—V. Paul Harper
(74) *Attorney, Agent, or Firm*—Milbank Tweed Hadley McCloy

(57) ABSTRACT

A speech synthesizing apparatus extracts small speech segments from a speech waveform as a prosody control target and adds inhibition information for inhibiting a predetermined prosody change process to a selected small speech segment in executing prosody control. Prosody control is performed by performing a predetermined prosody change process by using small speech segments of the extracted small speech segments other than small speech segments to which inhibition information is added. This makes it possible to prevent a deterioration in synthesized speech due to waveform editing operation.

35 Claims, 9 Drawing Sheets

SPEECH SYNTHESIZING METHOD AND APPARATUS USING PROSODY CONTROL

FIELD OF THE INVENTION

The present invention relates to a speech synthesizing method and apparatus for obtaining high-quality synthesized speech.

BACKGROUND OF THE INVENTION

As a speech synthesizing method of obtaining desired synthesized speech, a method of generating synthesized speech by editing and concatenating speech segments in units of phonemes or CV/VC, VCV, and the like is known. Note that CV/VC is a unit with a speech segment boundary set in each phoneme, and VCV is a unit with a speech segment boundary set in a vowel.

FIGS. 9A to 9C are views schematically showing an example of a method of changing the duration length and fundamental frequency of one speech segment. The speech waveform of one speech segment shown in FIG. 9A is divided into a plurality of small speech segments by a plurality of window functions in FIG. 9B. In this case, for a voiced sound portion (a voiced sound region in the second half of a speech waveform), a window function having a time width synchronous with the pitch of the original speech is used. For an unvoiced sound portion (an unvoiced sound region in the first half of the speech waveform), a window function having an appropriate time width (longer than that for a voiced sound portion in general) is used.

By repeating a plurality of small speech segments obtained in this manner, thinning out some of them, and changing the intervals, the duration length and fundamental frequency of synthesized speech can be changed. For example, the duration length of synthesized speech can be reduced by thinning out small speech segments, and can be increased by repeating small speech segments. The fundamental frequency of synthesized speech can be increased by reducing the intervals between small speech segments of a voiced sound portion, and can be decreased by increasing the intervals between the small speech segments of the voiced sound portion. By overlapping a plurality of small speech segments obtained by such repetition, thinning out, and interval changes, synthesized speech having a desired duration length and fundamental frequency can be obtained.

Speech, however, has steady and unsteady portions. If the above waveform editing operation (i.e., repeating small speech segments, thinning out small speech segments, and changing the intervals between them) is performed for an unsteady portion (especially, a portion near the boundary between a voiced sound portion and an unvoiced sound portion at which the shape of a waveform greatly changes), synthesized speech may have a rounded waveform or abnormal sounds may be produced, resulting in a deterioration in synthesized speech.

SUMMARY OF THE INVENTION

The present invention has been made in consideration of the above problems, and has as its object to prevent a deterioration in synthesized speech due to waveform editing operation.

In order to achieve the above object, according to the present invention, there is provided a speech synthesizing method comprising the extraction step of extracting a plurality of small speech segments from a speech waveform, the prosody control step of processing the plurality of small speech segments to control prosody of the speech waveform while limiting processing for a selected small speech segment of the plurality of small speech segments, and the synthesizing step of obtaining synthesized speech by using the speech waveform for which prosody control is performed in the prosody control step.

In order to achieve the above object, according to the present invention, there is provided a speech synthesizing apparatus comprising extraction means for extracting a plurality of small speech segments from a speech waveform, prosody control means for processing the plurality of small speech segments to control prosody of the speech waveform while limiting processing for a selected small speech segment of the plurality of small speech segments, and synthesizing means for obtaining synthesized speech by using the speech waveform for which prosody control is performed by the prosody control means.

Preferably, this method further comprises a means (step) for adding limitation information for inhibiting a predetermined process to the selected small speech segment, and the execution of the predetermined process for the small speech segment to which the limitation information is added is inhibited in executing the prosody control.

Preferably, the predetermined process includes one of deletion of a small speech segment to shorten the utterance time of synthesized speech, repetition of a small speech segment to prolong the utterance time of synthesized speech, and a change in the interval of a small speech segment to change the fundamental frequency of synthesized speech.

Preferably, a plurality of window functions arranged along a time axis and limitation information corresponding to at least one of the window functions are stored, small speech segments are extracted from a speech waveform by using the plurality of window functions, and when limitation information is made to correspond to a window function, the limitation information is added to a small speech segment extracted by using the window function. Since limitation information is made to correspond to a window function, and the limitation function is added to a small speech segment extracted with this window function, limitation information management and adding processing can be implemented with a simple arrangement.

Preferably, the limitation information is added to a small speech segment corresponding to a specific position on a speech waveform. In prosody control, the processing at the specific position can be inhibited, thereby maintaining sound quality more properly.

Preferably, the specific position includes at least one of the boundary between a voiced sound portion and an unvoiced source portion and a phoneme boundary. In addition, the specific position may be a predetermined range including a plosive, and a plurality of small speech segments may be included in the predetermined range.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
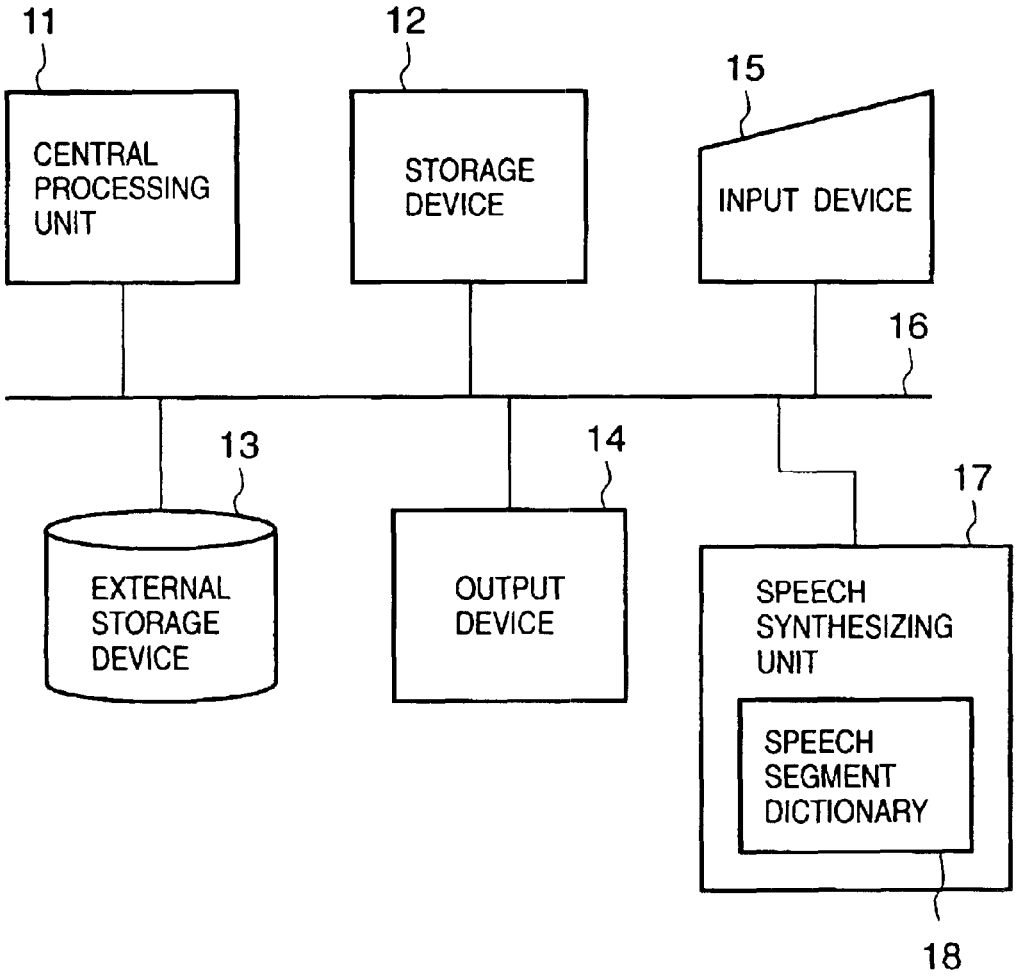
FIG. 1 is a block diagram showing the hardware arrangement of a speech synthesizing apparatus according to this embodiment.

FIG. 1 is a block diagram showing the hardware arrangement of a speech synthesizing apparatus according to this embodiment. Referring to FIG. 1, reference numeral 11 denotes a central processing unit for performing processing such as numeric operation and control, which realizes control to be described later with reference to the flow chart of FIG. 2; 12, a storage device including a RAM, ROM, and the like, in which a control program required to make the central processing unit 11 realize the control described later with reference to the flow chart of FIG. 2 and temporary data are stored; and 13, an external storage device such as a disk device storing a control program for controlling speech synthesis processing in this embodiment and a control program for controlling a graphical user interface for receiving operation by a user.

Reference numeral 14 denotes an output device formed by a speaker and the like, from which synthesized speech is output. The graphical user interface for receiving operation by the user is displayed on a display device. This graphical user interface is controlled by the central processing unit 11. Note that the present invention can also be incorporated in another apparatus or program to output synthesized speech. In this case, an output is an input for this apparatus or program.

Reference numeral 15 denotes an input device such as a keyboard, which converts user operation into a predetermined control command and supplies it to the central processing unit 11. The central processing unit 11 designates a text (in Japanese or another language) as speech synthesis target, and supplies it to a speech synthesizing unit 17. Note that the present invention can also be incorporated as part of another apparatus or program. In this case, input operation is indirectly performed through another apparatus or program.

Reference numeral 16 denotes an internal bus, which connects the above components shown in FIG. 1; and 17, a speech synthesizing unit for synthesizing speech from an input text by using a speech segment dictionary 18. Note that the speech segment dictionary 18 may be stored in the external storage device 13.

Figure 2:
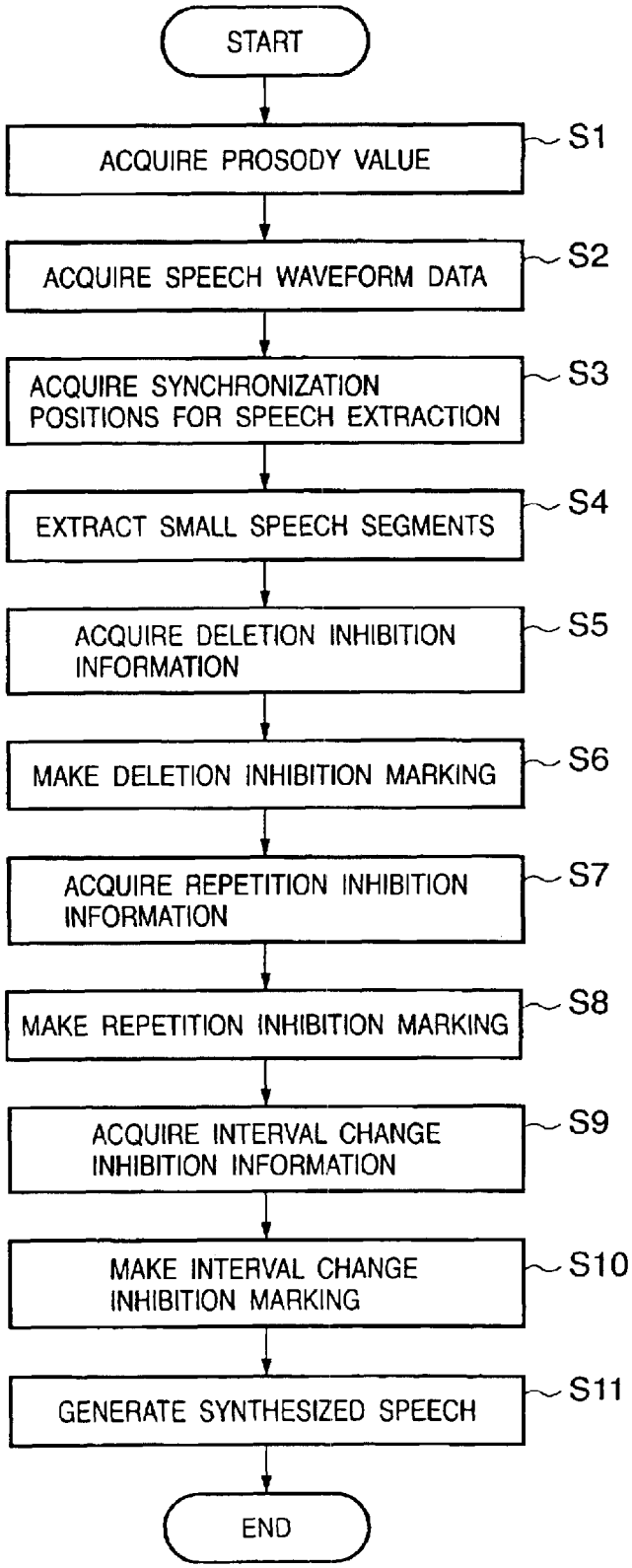
FIG. 2 is a flow chart showing a procedure for speech synthesis according to this embodiment.

An embodiment of the present invention will be described below in consideration of the above hardware arrangement. FIG. 2 is a flow chart showing a procedure for processing in the speech synthesizing unit 17. A speech synthesizing method according to this embodiment will be described below with reference to this flow chart.

Figure 3:
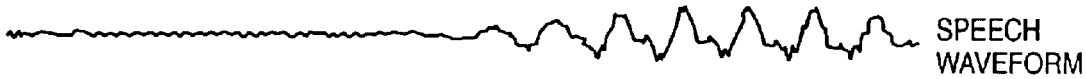
FIG. 3 is a view showing an example of speech waveform data loaded in step S2.

In step S1, language analysis and acoustic processing are performed for an input text to generate a phoneme series representing the text and prosody information of the phoneme series. In this case, the prosody information includes a duration length, fundamental frequency, and the like. A prosody unit is a diphone, phoneme, syllable, or the like. In step S2, speech waveform data representing a speech segment as one prosody unit is read out from the speech segment dictionary 18 on the basis of the generated phoneme series. FIG. 3 is a view showing an example of the speech waveform data read out in step S2.

Figure 4A:
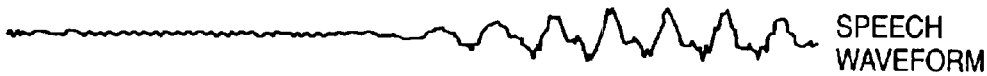
FIG. 4A is a view showing a speech waveform.
Figure 4B:
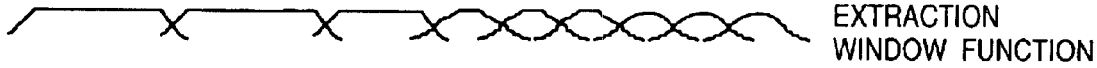
FIG. 4B is a view showing window functions generated on the basis of the synchronization position acquired in association with the speech waveform in FIG. 4A.
Figure 5A:
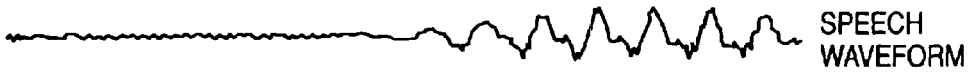
FIG. 5A is a view showing a speech waveform.
Figure 5B:
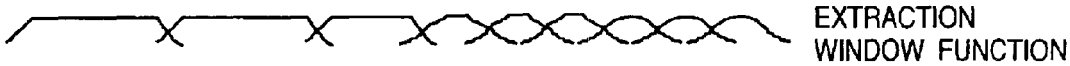
FIG. 5B is a view showing window functions generated on the basis of synchronization positions acquired in association with the speech waveform in FIG. 5A.
Figure 5C:
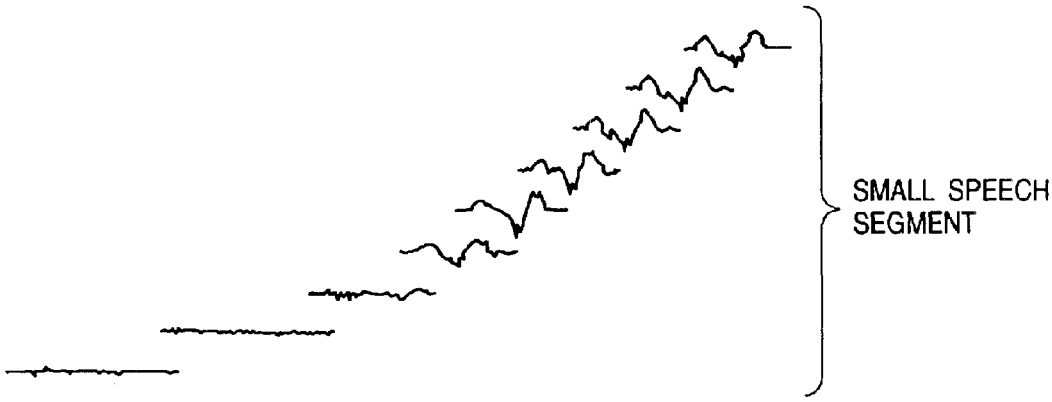
FIG. 5C is a view showing small speech segments obtained by applying the window functions in FIG. 5B to the speech waveform in FIG. 5A.

In step S3, the pitch synchronization positions of the speech waveform data acquired in step S2 and the corresponding window functions are read out from the speech segment dictionary 18. FIG. 4A is a view showing a speech waveform. FIG. 4B is a view showing a plurality of window functions corresponding to the pitch synchronization positions of the speech waveform. The flow then advances to step S4 to extract the speech waveform data loaded in step S2 by using the plurality of window functions loaded in step S3, thereby obtaining a plurality of small speech segments. FIG. 5A shows a speech waveform. FIG. 5B shows a plurality of window functions corresponding to the pitch synchronization positions of the speech waveform. FIG. 5C shows the plurality of small speech segments obtained by using the window functions in FIG. 5B.

In the following processing in steps S5 to S10, limitations on waveform editing operation for each small speech segment are checked by using the speech segment dictionary 18. In this embodiment, in the speech segment dictionary 18, editing limitation information (information of limitations on waveform editing operation) is added to a window function corresponding to each small speech segment on which a waveform editing operation limitation such as deletion, repetition, and interval change is imposed. The speech synthesizing unit 17 therefore checks editing limitation information for a given small speech segment by discriminating a specific ordinal number of a window function by which the small speech segment is extracted. In this embodiment, as editing limitation information, a speech segment dictionary is used, which stores, as editing limitation information, deletion inhibition information indicating a small speech segment which should not be deleted, repetition inhibition information representing a small speech segment which should not be repeated, and internal change inhibition information representing a small speech segment for which an interval change is inhibited.

The following are examples of the editing limitation information registered in the speech segment dictionary:

(1) "voiced/unvoiced boundary": Since "voiced/unvoiced boundary" is information to be used in another process in speech synthesis, it is stored as "voiced/unvoiced boundary information" in the speech segment dictionary. The rule that "repetition/deletion inhibition" should be added for a voiced/unvoiced boundary is applied to a program during execution. Note that voiced/unvoiced boundary information is registered in the dictionary after it is automatically detected without any modification by the user.

(2) "plosive": If a small speech segment is a plosive, the editing limitation information of "repetition/deletion inhibition" is registered in the speech segment dictionary. Note that a small speech segment at the time point of plosion is manually designated, and editing limitation information is added to it.

(3) "spectrum change amount": A small speech segment exhibiting a large spectrum change amount is automatically discriminated, and editing limitation information is added to it. In this embodiment, "repetition/deletion inhibition" is added to a small speech segment exhibiting a large spectrum change amount.

Note that a person determines what editing limitation is appropriate for a certain phenomenon (plosion or the like), and makes a rule based on the determination, thereby registering the corresponding information in the dictionary.

Figure 6A:
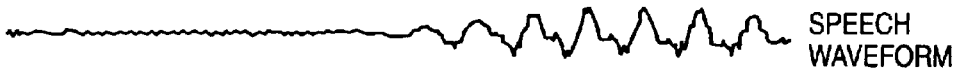
FIG. 6A is a view showing a speech waveform.
Figure 6B:
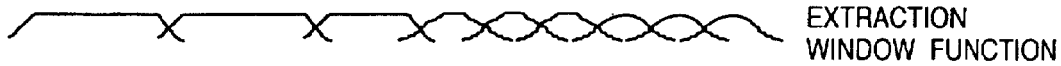
FIG. 6B is a view showing window functions generated on the basis of synchronization positions acquired in association with the speech waveform in FIG. 6A.
Figure 6C:
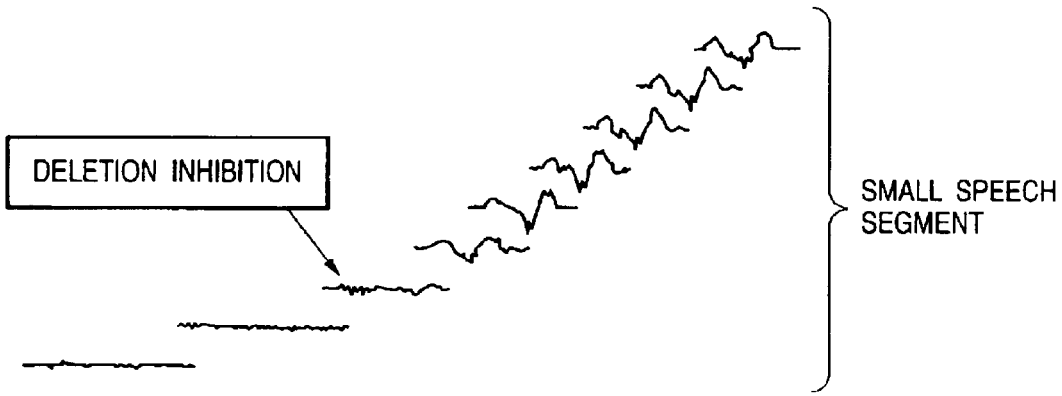
FIG. 6C is a view showing how a marking of "deletion inhibition" is made on one of the small speech segments obtained by applying the window functions in FIG. 6B to the speech waveform in FIG. 6A.

In step S5, editing limitation information added to each window function is checked to obtain a window function to which deletion inhibition information is added. In step S6, a marking that indicates deletion inhibition with respect to a small speech segment corresponding to the window function is made. FIGS. 6A to 6C show how the marking of "deletion inhibition" is made on a small speech segment. The speech segment dictionary 18 in this embodiment stores deletion inhibition information for a window function corresponding to an unsteady portion of a speech segment (especially, a portion near the boundary between a voiced sound portion and an unvoiced sound portion at which the shape of a waveform greatly changes). Referring to FIGS. 6A to 6C, the marking of "deletion inhibition" is made on the small speech segment obtained by the third window function (corresponding to the boundary between the voiced sound portion and the unvoiced sound portion). In the speech segment dictionary 18 in this embodiment, "deletion inhibition" is added to the third window function, and the marking of deletion inhibition is made as shown in FIG. 6C.

Figure 7A:
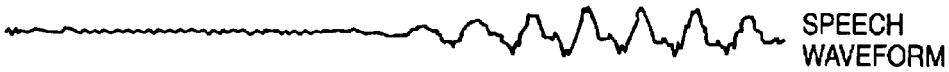
FIG. 7A is a view showing a speech waveform.
Figure 7B:
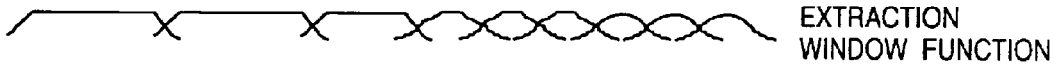
FIG. 7B is a view showing window functions generated on the basis of synchronization positions acquired in association with the speech waveform in FIG. 7A.
Figure 7C:
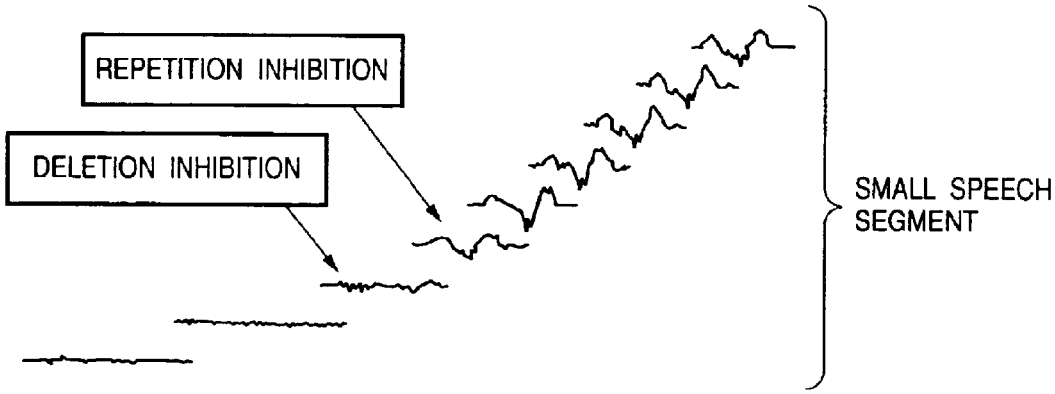
FIG. 7C is a view showing how a marking of "repetition inhibition" is made on one of the small speech segments obtained by applying the window functions in FIG. 7B to the speech waveform in FIG. 7A.

Likewise, in step S7, editing limitation information added to each window function is checked to obtain a window function to which repetition inhibition information is added. In step S8, a marking that indicates repetition inhibition is made with respect to a small speech segment corresponding to the window function obtained in step S7. FIGS. 7A to 7C are views showing how the marking of "repetition inhibition information" is made on a predetermined small speech segment. The speech segment dictionary 18 in this embodiment stores repetition inhibition information for a window function corresponding to an unsteady portion of a speech segment (especially, a portion near the boundary between a voiced sound portion and an unvoiced sound portion at which the shape of a waveform greatly changes). Referring to FIGS. 7A to 7C, the marking of "repetition inhibition information" is made on the small speech segment obtained by the fourth window function (corresponding to the head portion of the voiced sound portion). In the speech segment dictionary 18 in this embodiment, "repetition inhibition information" is added to the fourth window function, and the marking is made as shown in FIG. 7C. Note that the marking of "deletion inhibition" indicates the marking made in step S6 (see FIGS. 6A to 6C).

Figure 8A:
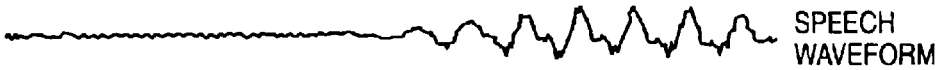
FIG. 8A is a view showing a speech waveform.
Figure 8B:
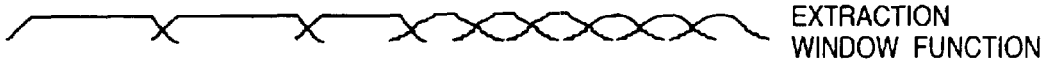
FIG. 8B is a view showing window functions generated on the basis of synchronization positions acquired in association with the speech waveform in FIG. 8A.
Figure 8C:
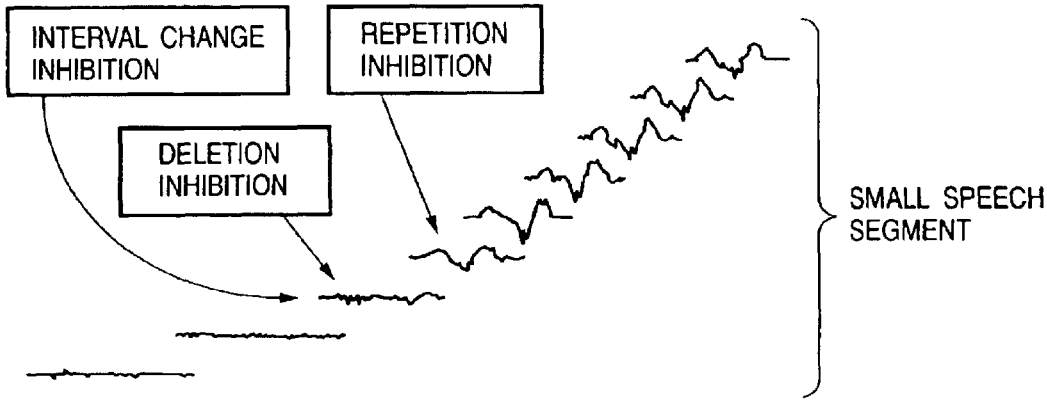
FIG. 8C is a view showing how a marking of "interval change inhibition" is made on one of the small speech segments obtained by applying the window functions in FIG. 8B to the speech waveform in FIG. 8A.
Figure 9A:
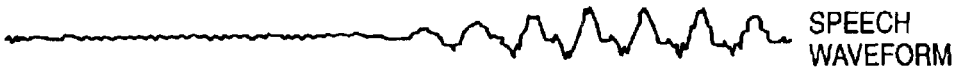
FIGS. 9A to 9C are views schematically showing a method of dividing a speech waveform (speech segment) into small speech segments, and prolonging/shortening the time of synthesized speech and changing the fundamental frequency.
Figure 9B:
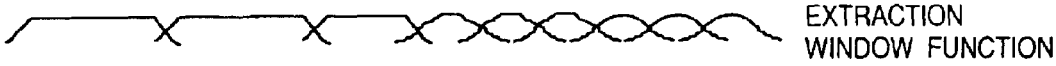
Figure 9C:
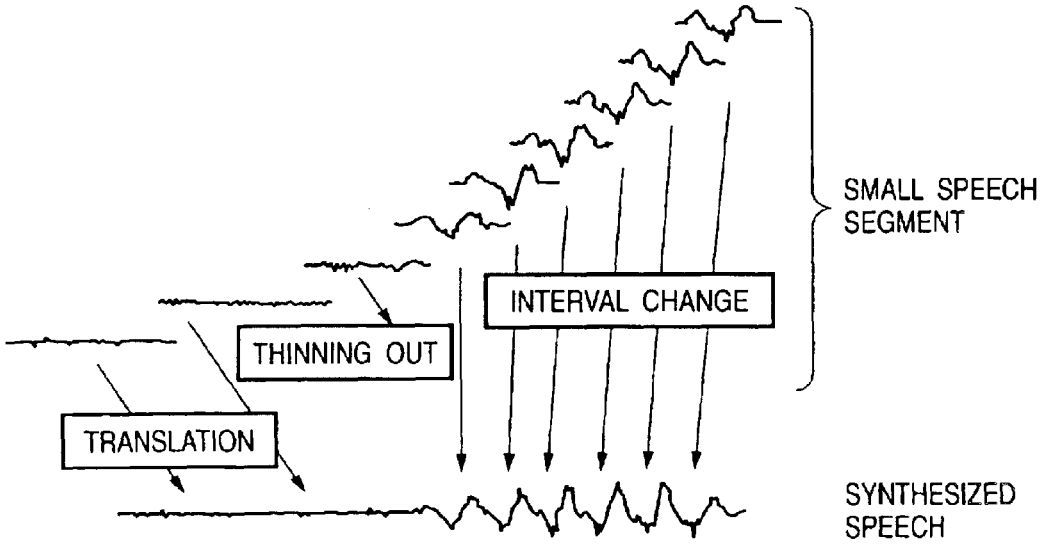

In step S9, the editing limitation information added to each window function is checked to obtain a window function to which interval change inhibition information is added. In step S10, a marking that indicates interval change inhibition is made with respect to a small speech segment corresponding to the window function obtained in step S9. FIGS. 8A to 8C are views showing how the marking of "interval change inhibition information" is made on a predetermined small speech segment. The speech segment dictionary 18 in this embodiment stores interval change inhibition information for a window function corresponding to an unsteady portion of a speech segment (especially, a portion near the boundary between a voiced sound portion and an unvoiced sound portion at which the shape of a waveform greatly changes). Referring to FIGS. 8A to 8C, the marking of "interval change inhibition information" is made on the small speech segment obtained by the third window function (corresponding to the boundary between the voiced sound portion and the unvoiced sound portion). In the speech segment dictionary 18 in this embodiment, "interval change inhibition information" is added to the third window function, and the marking is made as shown in FIG. 8C. Note that the markings of "deletion inhibition" and "repetition inhibition information" indicate the markings made in steps S6 and S8 (see FIGS. 6A to 6C and 7A to 7C).

In step S11, the small speech segments extracted in step S4 are arranged and overlapped again to match the prosody information obtained in step S1, thereby completing editing operation for one speech segment. When the duration length is to be decreased, a small speech segment on the marking of "deletion inhibition" does not become a deletion target. When the duration length is to be increased, a small speech segment on which the marking of "repetition inhibition" is made does not become a repetition target. When the fundamental frequency is to be changed, a small speech segment on which the marking of "interval change inhibition" does not become an interval change target. The above waveform editing operation is then performed for all the speech segments constituting the phoneme series obtained in step S1, and synthesized speech corresponding to the input text is obtained by concatenating the respective speech segments. This synthesized speech is output from the speaker of the output device 14. In step S11, the waveform of each speech segment is edited by using the PSOLA (Pitch-Synchronous Overlap Add) method.

As described above, according to the above embodiment, by setting waveform editing operation permission/inhibition information about deletion, repetition, interval change, and the like for each small speech segment obtained from a speech segment as one prosody unit, waveform editing operation limitations can be imposed on unsteady portions of each speech segment (especially, a portion near the boundary between a voiced sound portion and an unvoiced sound portion at which the shape of a waveform greatly changes). This makes it possible to suppress the occurrence of rounded speech waveforms and strange sounds due to changes in duration length and fundamental frequency, thus obtaining more natural synthesized speech.

In the above embodiment, the positions of window functions are used for deletion inhibition information, repetition inhibition information, and interval change inhibition information. However, they may be acquired as indirect information. More specifically, boundary information such as a phoneme boundary or voice/unvoiced boundary is acquired, and the marking of deletion inhibition, repetition inhibition, and interval change inhibition may be made on a small speech segment located at the boundary.

In the above embodiment, deletion inhibition information, repetition inhibition information, and interval change inhibition information may not be information indicating a small speech segment but may be information indicating a specific interval. More specifically, information at the time point of plosion may be acquired from a plosive, and the marking of deletion inhibition, repetition inhibition, or interval change inhibition may be made on a small speech segment present in intervals before and after the time point of plosion.

The present invention may be applied to a system constituted by a plurality of devices (e.g., a host computer, an interface device, a reader, a printer, and the like) or an apparatus comprising a single device (e.g., a copying machine, a facsimile apparatus, or the like).

The present invention can also be applied to a case wherein a storage medium storing software program codes for realizing the functions of the above-described embodiment is supplied to a system or apparatus, and the computer (or a CPU or an MPU) of the system or apparatus reads out and executes the program codes stored in the storage medium. In this case, the program codes read out from the storage medium realize the functions of the above-described embodiment by themselves, and the storage medium storing the program codes constitutes the present invention. The functions of the above-described embodiment are realized not only when the readout program codes are executed by the computer but also when the OS (Operating System) running on the computer performs part or all of actual processing on the basis of the instructions of the program codes.

The functions of the above-described embodiment are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

As has been described above, according to the present invention, processing for prosody control can be selectively limited with respect to small speech segments in each speech segment, thereby preventing a deterioration in synthesized speech due to waveform editing operation.

As many apparently widely different embodiments of the present invention can be made without departing from the spirit and scope thereof, it is to be understood that the invention is not limited to the specific embodiments thereof except as defined in the claims.

What is claimed is:

1. A speech synthesizing method comprising:

an extraction step of extracting a plurality of speech segments from a speech waveform;

an adding step of adding limitation information for inhibiting execution of predetermined processing to a selected speech segment of the plurality of speech segments;

a prosody control step of processing the plurality of speech segments to control prosody of the speech waveform, wherein the prosody control step inhibits execution of the predetermined processing for a speech segment to which the limitation information is added; and a synthesizing step of obtaining synthesized speech by using the speech waveform for which prosody control is performed in the prosody control step.

2. The method according to claim 1, wherein the predetermined processing includes deletion of a speech segment, and in the prosody control step, deletion of the speech segment to which the limitation information is added is inhibited when reduction of an utterance time of synthesized speech is performed as the prosody control.

3. The method according to claim 1, wherein the predetermined processing includes repetition of a speech segment, and in the prosody control step, repetition of a speech segment to which the limitation information is added is inhibited when prolongation of a time of synthesized speech is performed as the prosody control.

4. The method according to claim 1, wherein the predetermined processing includes a change in an interval of a speech segment, and in the prosody control step, a change in an interval of a speech segment to which the limitation information is added is inhibited when making a change in a fundamental frequency of synthesized speech as the prosody control.

5. The method according to claim 1, wherein a storage unit in which a plurality of window functions arranged along a time axis and limitation information corresponding to at least one of the window functions are stored is used, in the extraction step, speech segments are extracted from a speech waveform by using the plurality of window functions, and in the prosody control step, when limitation information is made to correspond to a window function, a speech segment extracted by using the window function is selected and the limitation is imposed on the speech segment on the basis of the limitation information.

6. The method according to claim 1, wherein in the adding step, the limitation information is added to a speech segment corresponding to a specific position on a speech waveform.

7. The method according to claim 6, wherein the specific position includes a boundary between a voiced sound portion and an unvoiced sound portion.

8. The method according to claim 6, wherein the specific position includes a phoneme boundary.

9. The method according to claim 6, wherein the specific position is a predetermined range including a plosive, and the predetermined range includes a plurality of speech segments.

10. The method according to claim 1, wherein the speech waveform comprises the plurality of speech segments; and wherein the prosody control step do not execute the predetermined processing to the speech segments in case that the limitation information is effective.

11. A speech synthesizing apparatus comprising:

an extraction unit configured to extract a plurality of speech segments from a speech waveform;

an adding unit configured to add limitation information for inhibiting execution of predetermined processing to a selected speech segment of the plurality of speech segments;

a prosody control unit configured to process the plurality of speech segments to control prosody of the speech waveform, wherein the prosody control step inhibits execution of the predetermined processing for a speech segment to which the limitation information is added; and a synthesizing unit configured to obtain synthesized speech by using the speech waveform for which prosody control is performed by said prosody control unit.

12. The apparatus according to claim 11, wherein the predetermined processing includes deletion of a speech segment, and said prosody control unit inhibits deletion of the speech segment to which the limitation information is added when reduction of an utterance time of synthesized speech is performed as the prosody control.

13. The apparatus according to claim 11, wherein the predetermined processing includes repetition of a speech segment, and said prosody control unit inhibits repetition of a speech segment to which the limitation information is added when prolongation of a time of synthesized speech is performed as the prosody control.

14. The apparatus according to claim 11, wherein the predetermined processing includes a change in an interval of a speech segment, and said prosody control unit inhibits a change in an interval of a speech segment to which the limitation information is added when making a change in a fundamental frequency of synthesized speech as the prosody control.

15. The apparatus according to claim 11, further comprising a storage unit in which a plurality of window functions arranged along a time axis and limitation information corresponding to at least one of the window functions are stored, wherein said extraction unit extracts speech segments from a speech waveform by using the plurality of window functions, and said prosody control unit, when limitation information is made to correspond to a window function, selects a speech segment extracted by using the window function and imposes the limitation on the basis of the limitation information.

16. The apparatus according to claim 11, wherein said adding unit adds the limitation information to a speech segment corresponding to a specific position on a speech waveform.

17. The apparatus according to claim 16, wherein the specific position includes a boundary between a voiced sound portion and an unvoiced sound portion.

18. The apparatus according to claim 16, wherein the specific position includes a phoneme boundary.

19. The apparatus according to claim 16, wherein the specific position is a predetermined range including a plosive, and the predetermined range includes a plurality of speech segments.

20. The apparatus according to claim 11, wherein the speech waveform comprises the plurality of speech segments; and wherein the prosody control unit do not execute the predetermined processing to the speech segments in case that the limitation information is effective.

21. A control program for making a computer implement a speech synthesizing method comprising:

an extraction step of extracting a plurality of speech segments from a speech waveform;

an adding step of adding limitation information for inhibiting execution of predetermined processing to a selected speech segment of the plurality of speech segments;

a prosody control step of processing the plurality of speech segments to control prosody of the speech waveform, wherein the prosody control step inhibits execution of the predetermined processing for a speech segment to which the limitation information is added; and a synthesizing step of obtaining synthesized speech by using the speech waveform for which prosody control is performed in the prosody control step.

22. A storage medium storing a control program for making a computer implement a speech synthesizing method comprising;

an extraction step of extracting a plurality of speech segments from a speech waveform;

an adding step of adding limitation information for inhibiting execution of predetermined processing to selected speech segment of the plurality of speech segments;

a prosody control step of processing the plurality of speech segments to control prosody of the speech waveform, wherein the prosody control step inhibits execution of the predetermined processing for a speech segment to which the limitation information is added; and a synthesizing step of obtaining synthesized speech by using the speech waveform for which prosody control is performed in the prosody control step.

23. A speech synthesizing method comprising:

an extraction step of extracting a plurality of speech segments from a speech waveform;

a prosody control step of processing the plurality of speech segments to control prosody of the speech waveform, wherein the prosody control step inhibits execution of the predetermined processing for a speech segment based on the limitation information corresponding to the speech waveform; and a synthesizing step of obtaining synthesized speech by using the speech waveform for which prosody control is performed in the prosody control step.

24. The method according to claim 23, wherein the speech waveform comprises the plurality of speech segments; and wherein the prosody control step do not execute the predetermined processing to the speech segments in case that the limitation information is effective.

25. The method according to claim 24, wherein the limitation information is effective for a speech segment corresponding to a specific position on a speech waveform.

26. The method according to claim 25, wherein specific position includes a boundary between a voiced sound portion and an unvoiced sound portion.

27. The method according to claim 25, wherein specific position includes a phoneme boundary.

28. The method according to claim 25, wherein the specific position includes a plosive.

29. The method according to claim 23, wherein the predetermined processing includes deletion of a speech segment, and in the prosody control step, deletion of the speech segment is inhibited in case that prolongation of a time of synthesized speech is performed as the prosody control.

30. The method according to claim 23, wherein the predetermined processing includes repetition of a speech segment, and in the prosody control step, repetition of a speech segment is inhibited in case that prolongation of a time of synthesized speech is performed as the prosody.

31. The method according to claim 23, wherein the predetermined processing includes a change in an interval of a speech segment, and in the prosody control step, a change in an interval of a speech segment is inhibited in case that making a change in a fundamental frequency of synthesized speech as the prosody control.

32. A speech synthesizing apparatus comprising:

an extraction unit configured to extract a plurality of speech segments from a speech waveform;

a prosody control unit configured to process the plurality of speech segments to control prosody of the speech waveform, wherein the prosody control step inhibits execution of the predetermined processing for a speech segment based on the limitation information corresponding to the speech waveform; and a synthesizing unit configured to obtain synthesized speech by using the speech waveform for which prosody control is performed by said prosody control unit.

33. The apparatus according to claim 32, wherein the speech waveform comprises the plurality of speech segments; and wherein the prosody control unit do not execute the predetermined processing to the speech segments in case that the limitation information is effective.

34. A control program for making a computer implement a speech synthesizing method comprising:

an extraction step of extracting a plurality of speech segments from a speech waveform;

a prosody control step of processing the plurality of speech segments to control prosody of the speech waveform, wherein the prosody control step inhibits execution of the predetermined processing for a speech segment based on the limitation information corresponding to the speech waveform; and a synthesizing step of obtaining synthesized speech by using the speech waveform for which prosody control is performed in the prosody control step.

35. A storage medium storing a control program for making a computer implement a speech synthesizing method comprising:

an extraction step of extracting a plurality of speech segments from a speech waveform;

a prosody control step of processing the plurality of speech segments to control prosody of the speech waveform, wherein the prosody control step inhibits execution of the predetermined processing for a speech segment based on the limitation information corresponding to the speech waveform; and a synthesizing step of obtaining synthesized speech by using the speech waveform for which prosody control is performed in the prosody control step.

* * * * *